US007802448B2

(12) United States Patent
Chan

(10) Patent No.: US 7,802,448 B2
(45) Date of Patent: Sep. 28, 2010

(54) JEWELRY CLASP

(75) Inventor: Lok Chan, Hong Kong (CN)

(73) Assignee: H.K.C.J. (Asia) Ltd., Tsuen Wan N.T. (HK)

( * ) Notice: Subject to any disclaimer, the term of this patent is extended or adjusted under 35 U.S.C. 154(b) by 366 days.

(21) Appl. No.: 11/737,048

(22) Filed: Apr. 18, 2007

(65) Prior Publication Data

US 2008/0256978 A1 Oct. 23, 2008

(51) Int. Cl.
*A44C 5/00* (2006.01)

(52) U.S. Cl. ..... 63/3.1; 24/303; 63/900

(58) Field of Classification Search ..... None
See application file for complete search history.

(56) References Cited

U.S. PATENT DOCUMENTS 2,623,256 A * 12/1952 Feibelman ..... 24/303
5,050,276 A * 9/1991 Pemberton ..... 24/303
7,254,962 B2 * 8/2007 Scharr ..... 63/40
7,441,917 B1 * 10/2008 Underdown et al. ..... 362/103
2009/0013720 A1 * 1/2009 Altick ..... 63/3.1

* cited by examiner

*Primary Examiner*—Jack W. Lavinder
(74) *Attorney, Agent, or Firm*—Kenneth H. Jack; Davis & Jack, L.L.C.

(57) ABSTRACT

A jewelry assembly incorporating a body portion, the body portion being halved, each half of the body portion including a magnetic fastener half; a strand anchoring pin and socket joint fixedly attached to one of the clasp's halves; a helically threaded void extending into the other of the clasp's halves; a helically threaded lug fitted for threaded engagement with the helically threaded void, and a flexible bead supporting strand spanning between and interconnecting the body portion's halves.

5 Claims, 5 Drawing Sheets

JEWELRY CLASP

REFERENCE TO PREVIOUSLY FILED PROVISIONAL APPLICATION

The following non-provisional patent application is directed to and claims priority from, and claims the benefit of the filing date of Provisional Patent Application No. 60/735,435 filed Apr. 24, 2006, with the U.S. Patent and Trademark Office. The inventor under said Application No. 60/745,435 and the inventor under the instant Application are one and the same.

That all drawings and sections of said Provisional Application are identical to the instant Application.

FIELD OF THE INVENTION

This invention relates to jewelry clasps. More particularly, this invention relates to jewelry clasps which are utilized for securing bead bearing bracelets or necklaces about wearer's wrists or necks.

BACKGROUND OF THE INVENTION

Common bracelet or necklace clasps such as magnetic clasps, spring ring clasps, and "lobster claw" clasps perform the function of securing a flexible strand bracelet or necklace about a wearer's wrist or neck. Such bracelets or necklaces are commonly known to include and support a series of decorative beads. The flexible strand of such bracelet or necklace typically extends through such beads' hollow bores. Where such bracelets or necklaces bear such decorative beads, the clasp portions of such bracelets or necklaces advantageously dually function as connecting means and as slide stops. The clasp's slide stop function advantageously prevents the decorative beads from undesirably falling from the ends of the flexible strand.

A drawback or deficiency of common bracelets or necklaces, such as described above, is that the clasp portions of such bracelets or necklaces undesirably block or interfere with installations of such decorative beads onto the bracelet or necklace's strand.

The instant inventive jewelry clasp overcome drawbacks and deficiencies described above by uniquely configuring a jewelry clasp so that it may perform triple functions as connecting means, as slide stopping means for preventing beads from falling from a bracelet or necklace's strand, and as bead threading means, alternately allowing decorative beads to be easily and conveniently threaded over and mounted upon such strands.

BRIEF SUMMARY OF THE INVENTION

A first structural component of the instant inventive jewelry clasp comprises a halved body portion. The halved body portion may suitably include mechanical features which are similar to those of common two piece snap ring jewelry clasps, magnetic jewelry clasps, or "lobster claw" jewelry clasps. Where the common portion of the inventive jewelry clasp comprises a two piece magnetic clasp, such magnetic clasp typically includes left and right body portions, each body portion housing and supporting a magnet. Where the common portion of the inventive clasp comprises a snap ring clasp, such clasp preferably comprises a pair of rings, one ring among the pair including an alternately telescoping and retractable spring biased segment. Where the common portion of the inventive jewelry clasp comprises a "lobster claw" clasp, such clasp typically comprises a ring in combination with a lobster claw shaped element which includes a hooking portion and a spring biased hook closing portion.

A further structural component of the instant inventive jewelry clasp comprises means for anchoring a flexible strand. The strand preferably comprises monofilament plastic cording, a flexible wire, or a flexible wire cable. The strand element may have any suitable length. For example, where the strand is to function as a bracelet, the strand is typically between four and six inches in length. Where the strand is to serve as a necklace, the strand may be between twelve inches and thirty inches in length. One end of the strand is preferably fixedly secured to one of the halves of the clasp by means of soldering, adhesive bonding, or compressive fitting applied to a "pin and socket" joint. The pin of such joint preferably comprises a strand end and the socket is preferably formed by the clasp ball.

A further structural component of the instant inventive jewelry clasp preferably comprises a cylindrical metal lug having outwardly extending helical threads, and presenting a hollow socket. Such helically threaded lug preferably has an outside diameter which is fitted for passage through the hollow eye openings of common decorative beads. The opposite end of the strand element received by the instant invention is preferably fixedly mounted within the socket of such lug by means of soldering, compression fitting, or adhesive bonding.

A further structural component of the instant inventive jewelry clasp comprises a cylindrical helically threaded void extending into the opposite half of the clasp, such helically threaded void being fitted for threadedly receiving the helically threaded lug.

In use of the instant inventive jewelry clasp, the eyes of a plurality of decorative beads may be extended over the helically threaded lug and thence onto the strand element. Thereafter, the helically threaded lug, along with its attached strand end, may be threadedly mounted within the clasp's helically threaded void. Upon such threaded mounting, the clasp effectively functions as a bead retaining slide stop. In order to remove and interchange beads, the helically threaded lug may be oppositely rotated and threadedly removed. Thereafter, the beads may be extracted thereover, and new beads may be installed thereover, as desired. Thereafter, the lug may be threadedly reinstalled within the helically threaded void.

Accordingly, objects of the instant invention include provision of structures, as described above, wherein such structures are arranged for the performance of functions as described above.

Other and further objects, benefits, and advantages of the instant invention will become known to those skilled in the art upon review of the Detailed Description, which follows, and upon review of the appended drawings.

BRIEF DESCRIPTION OF THE DRAWINGS (Drawings FIGS. 1-6 described below are presented informally.)

DETAILED DESCRIPTION OF A PREFERRED EMBODIMENT

Figure 1:
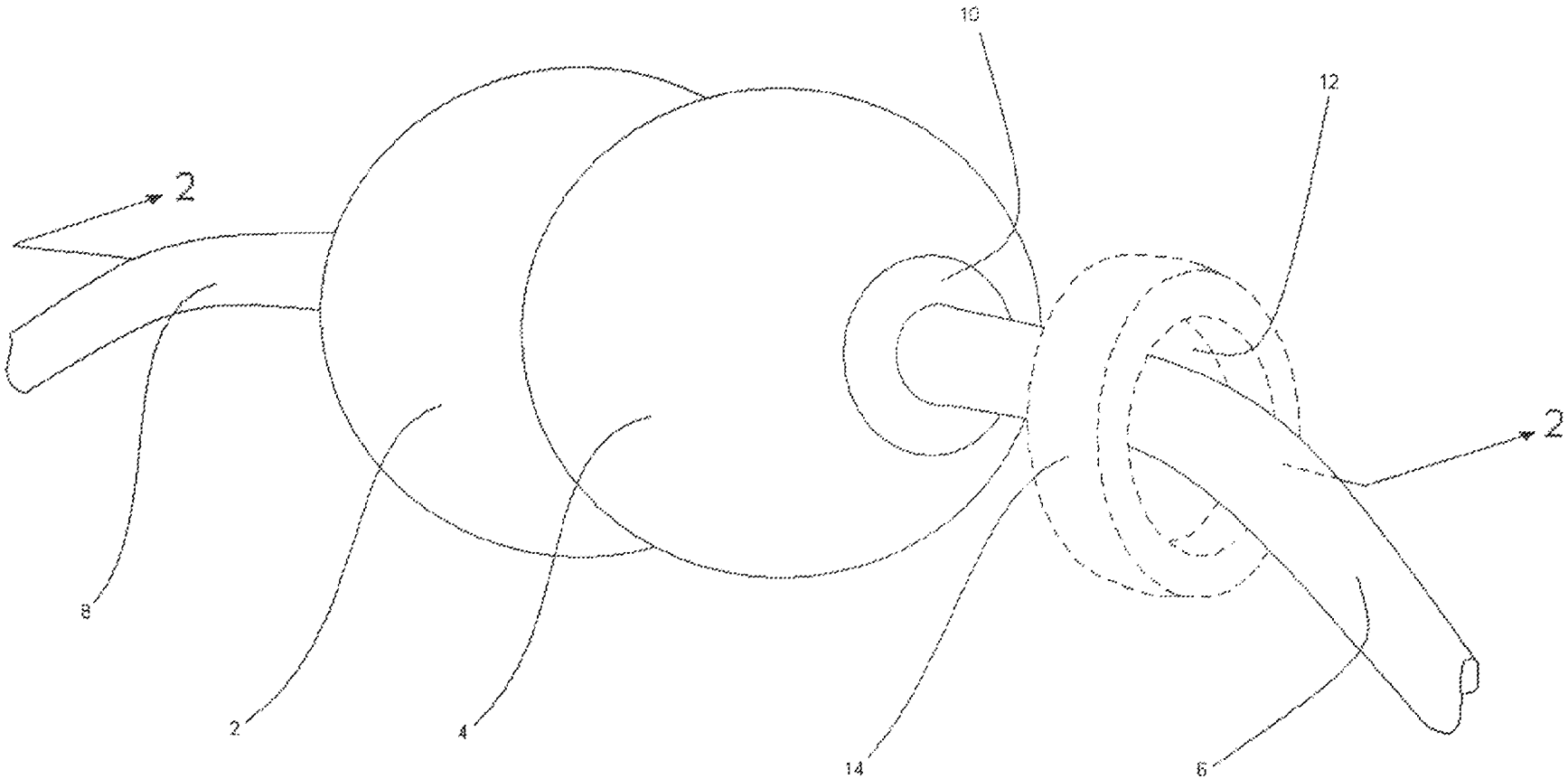
FIG. 1 is a perspective view of a preferred embodiment of the instant inventive jewelry clasp.
Figure 2:
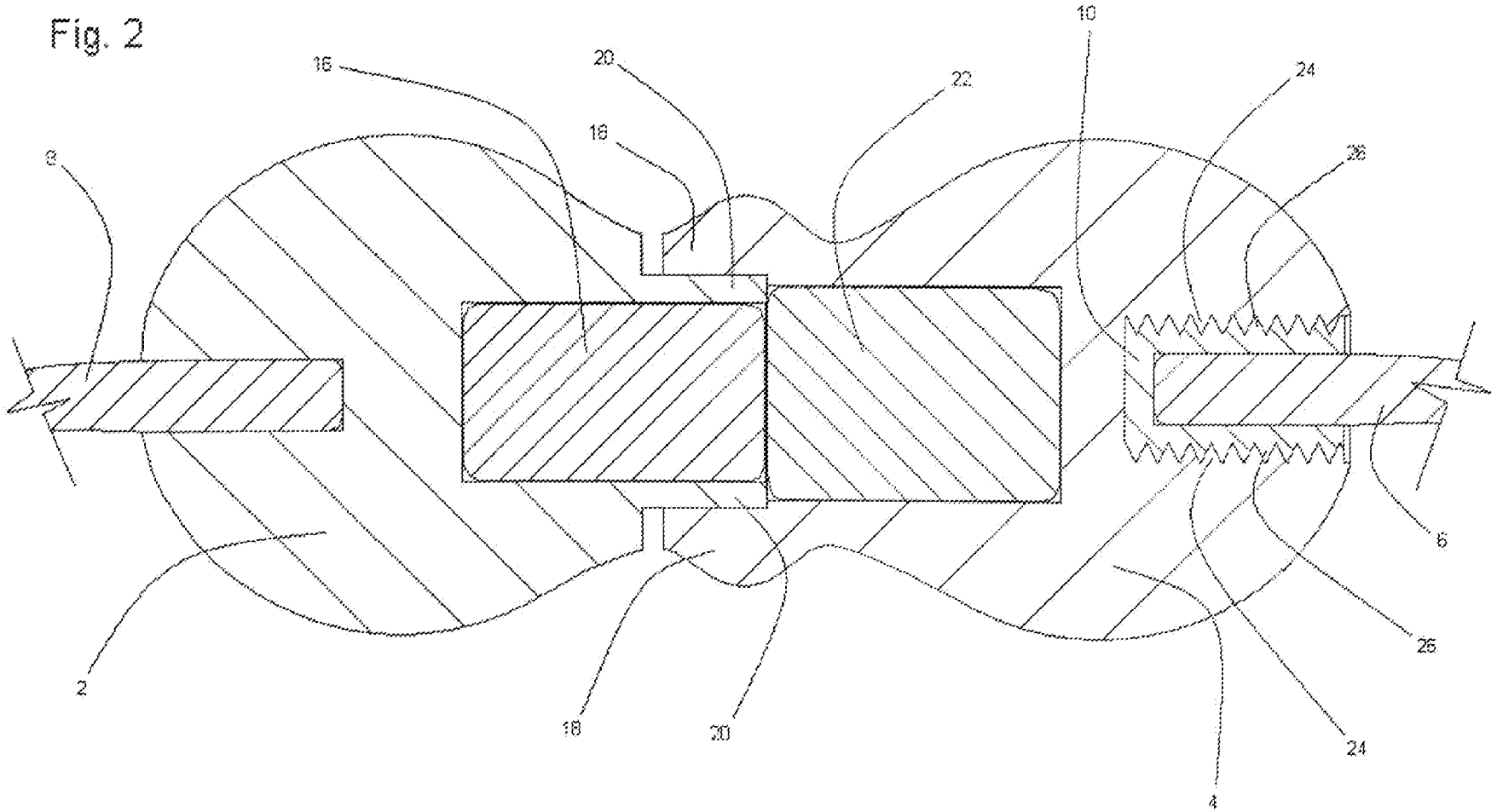
FIG. 2 is a sectional view as indicated in FIG. 1.
Figure 3:
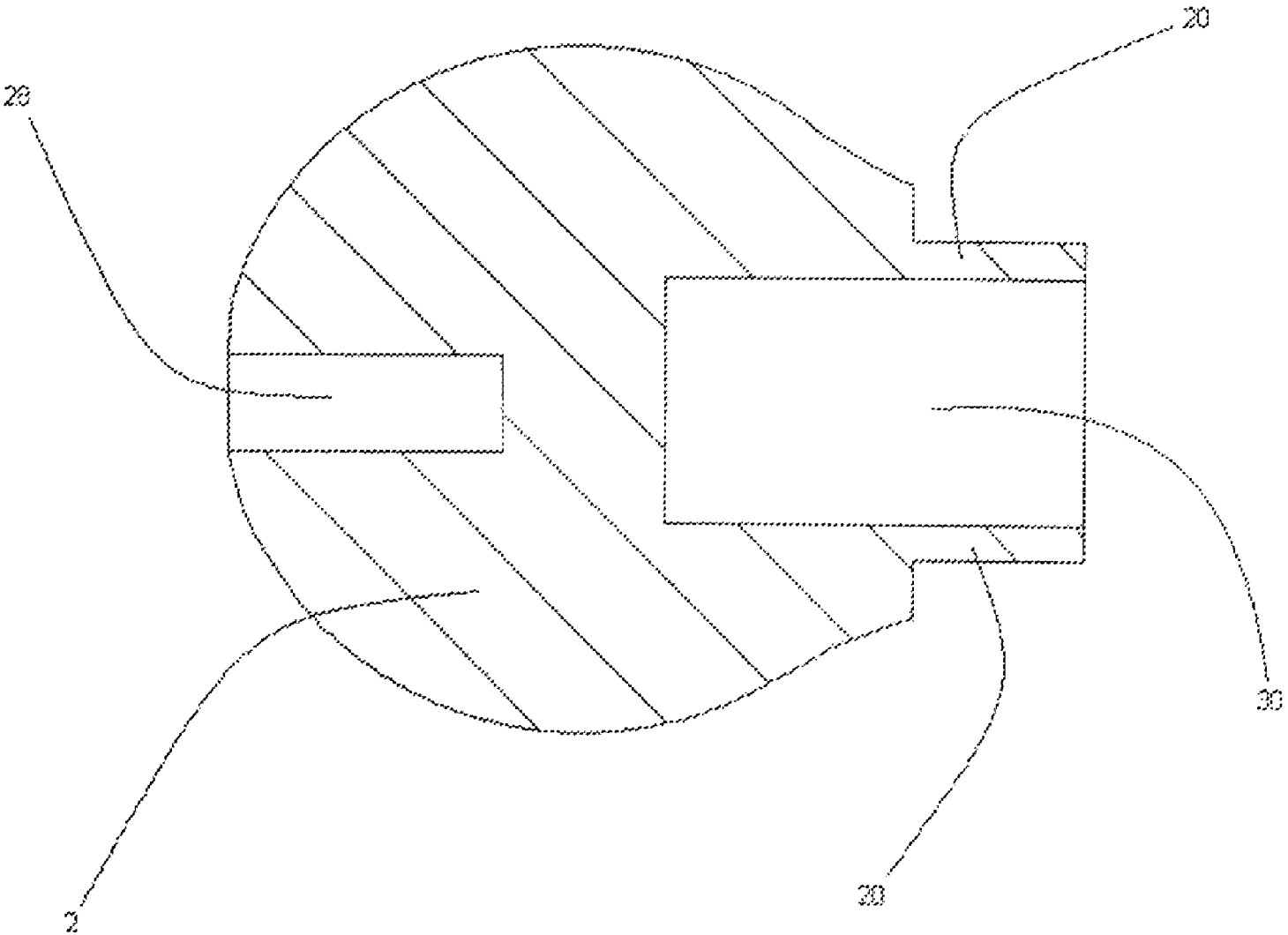
FIG. 3 is a sectional view of a first disassembled clasp half, the view of such section being as indicated in FIG. 1.

Referring now to the drawings, and in particular to FIG. 1, a magnetic jewelry clasp configuration of the instant invention is depicted, such clasp including a left body portion 2 and a right body portion 4. Referring further simultaneously to FIG. 3, the left body portion 2 of the clasp preferably includes a strand end receiving socket 28, and a rightwardly extending magnet receiving annular ridge 20, such ridge defining a rightwardly opening magnet receiving socket 30. Referring further simultaneously to FIG. 2, a left end 8 of a flexible strand is preferably extended into socket 28 and is preferably fixedly and permanently mounted therein by means of compression fitting, adhesive bonding, or soldering. A magnet 16 is preferably extended leftwardly into socket 30, and such magnet 16 is preferably permanently and fixedly mounted therein by means of compression fitting or adhesive bonding.

Figure 4:
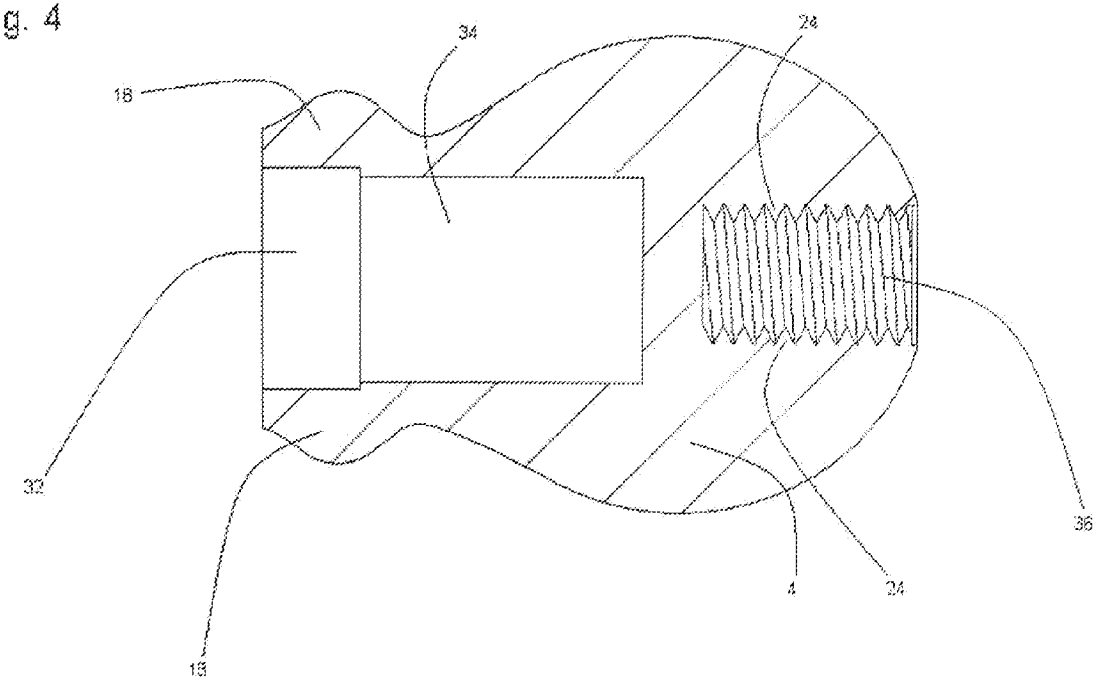
FIG. 4 is a sectional view of a second disassembled clasp half, the view of such section being as indicated in FIG. 1.
Figure 5:
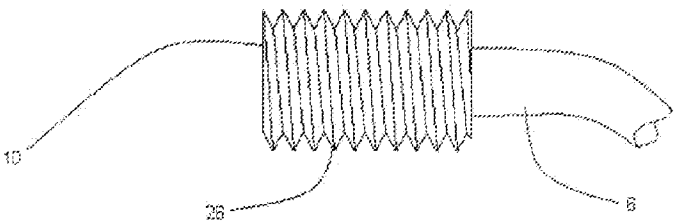
FIG. 5 is a side view of a threaded lug component of the instant inventive jewelry clasp.

Referring simultaneously to FIGS. 1, 2, and 4, the right body portion 4 of the magnetic clasp preferably includes a leftwardly extending annular ridge or slide sleeve section 18 which forms and defines a coffered hollow socket, such socket including a magnet receiving section 34 and an opposite clasp half securing section 32. A second magnet 22 is preferably extended rightwardly into the magnet receiving socket section 34, and such magnet is preferably permanently compression fitted or adhesively bonded therein.

Referring further simultaneously to FIGS. 1, 2, and 4, the clasp half body 4 preferably further comprises a rightwardly opening void 36, such void having internal helical threads 24.

Referring simultaneously to FIGS. 1, 2, 4, and 5, a cylindrical lug 10 is preferably provided, such lug 10 preferably having external helical threads 26 and having, referring further to FIG. 3, a strand end receiving socket similar to strand end socket 28. Such strand end socket preferably fixedly and permanently receives a rightward end 6 of the strand, such end being compression fitted, adhesively bonded, or soldered within such socket.

In use of the inventive clasp, referring to FIG. 1, the clasp may be initially configured as depicted. In the event that a user desires to remove bead 14 from the strand, the user may initially grasp clasp halves 2 and 4 and withdrawn them leftwardly and rightwardly from each other causing, referring further simultaneously to FIGS. 2, 3, and 4, the magnetic contact between magnet 16 and 22 to break, and causing annular ridge 20 to slidably retract from socket section 32. Thereafter, such user may manually unscrew the clasp half body portion 4 from the helically threaded lug 10. Thereafter, the user may withdraw the bead 14 over such lug 10, causing the lug 10 to pass through the central eye opening 12 of the bead 14. Thereafter, new or different beads may be extended over lug 10, and the lug 10 may be threadedly re-installed within the threaded void 36.

Figure 6:
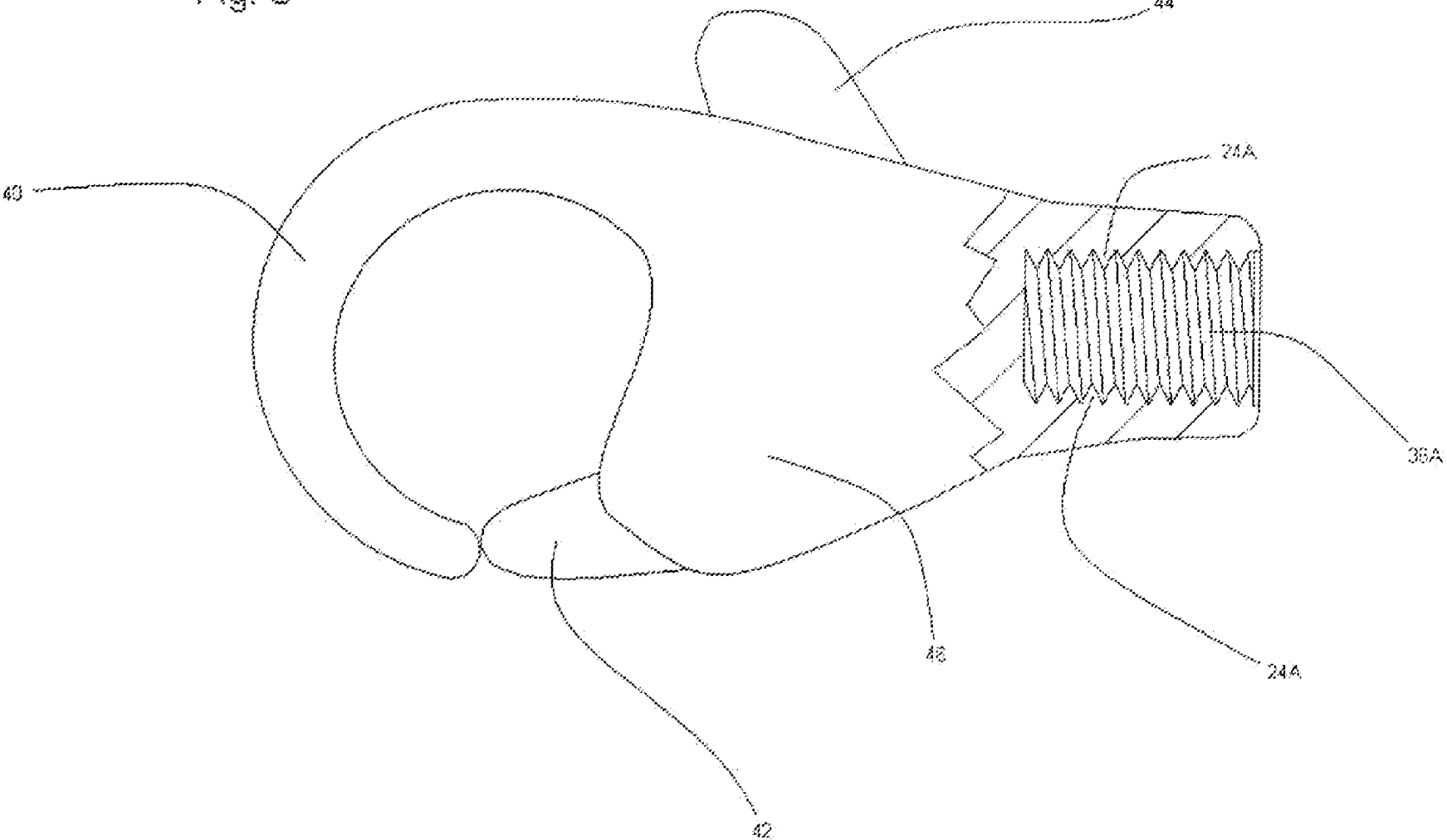
FIG. 6 depicts an alternate clasp embodiment.

FIG. 6 depicts an alternate clasp half configuration 46, such half being commonly known as a "lobster claw" clasp. Such clasp 46 has a hooking portion 40. Such hooking portion 40 typically engages an opposite clasp half commonly configured as an eye ring (not depicted). Such lobster claw clasp 46 also typically includes a spring biased closure element 42, such element being manually retractable and openable through pivotal rightward movement of lug 44. Reference numerals in FIG. 6 having the suffix "A" are substantially identical to and function substantially identically with similarly numbered structures appearing in FIG. 4.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A jewelry assembly comprising:

(a) a body portion, the body portion being halved, the body portion's halves comprising a left half and a right half;

(b) strand anchoring means fixedly attached to the body portion's left half;

(c) a rightwardly opening void, the rightwardly opening void extending leftwardly into the body portion's right half, the rightwardly opening void being helically threaded;

(d) a lug having a socket, the lug being helically threaded and fitted for leftward insertion into and for threaded engagement with the rightwardly opening void;

(e) second strand anchoring means selected from the group consisting of compression fittings, adhesive bonds, and soldered bonds, the second strand anchoring means being fixedly attached to the lug's socket;

(f) a flexible strand spanning between and interconnecting the body portion's left half and the lug's socket; and (g) a plurality of beads, each bead among the plurality of beads having an eye, each eye being fitted for passage there through of the lug, the flexible strand extending through each of the beads' eyes.

2. The jewelry assembly of claim 1 wherein the body portion comprises a strand connector selected from the group consisting of magnetic jewelry clasps, snap jewelry clasps, and "lobster claw" jewelry clasps.

3. The jewelry assembly of claim 1 wherein the flexible strand comprises a necklace or bracelet bead supporting member selected from the group consisting of monofilament plastic cording, flexible wire, and flexible wire cable.

4. The jewelry assembly of claim 1 wherein the flexible strand has a length between four inches and thirty inches.

5. The jewelry assembly of claim 1 wherein the lug is cylindrical and comprises metal.

* * * * *